US006456095B1

(12) United States Patent
Sorita et al.

(10) Patent No.: US 6,456,095 B1
(45) Date of Patent: Sep. 24, 2002

(54) GENERATOR INTERIOR COOLING GAS MONITOR AND MONITOR SYSTEM

(75) Inventors: Tetsuji Sorita, Tokyo; Mitsuru Takashima, Osaka, both of (JP)

(73) Assignees: Mitsubishi Denki Kabushiki Kaisha, Tokyo (JP); The Kansai Electric Power Co., Inc., Osaka (JP)

( * ) Notice: Subject to any disclaimer, the term of this patent is extended or adjusted under 35 U.S.C. 154(b) by 0 days.

(21) Appl. No.: 09/671,157

(22) Filed: Sep. 28, 2000

(30) Foreign Application Priority Data

Jun. 28, 2000 (JP) ..... 2000-194230

(51) Int. Cl.[7] ..... H01J 49/00
(52) U.S. Cl. ..... 324/703; 250/22.2; 250/221
(58) Field of Search ..... 250/22.2, 221, 250/222.1; 356/437, 438, 346; 324/703, 772, 312, 318

(56) References Cited

U.S. PATENT DOCUMENTS 3,427,880 A 2/1969 Grobel et al.
3,573,460 A 4/1971 Skala
3,972,225 A 8/1976 Fort et al.
RE34,806 E * 12/1994 Cann ..... 118/723 DC
6,175,111 B1 * 1/2001 Sorita et al. ..... 250/282

OTHER PUBLICATIONS

Carson et al.; "Immediate Detection of Overheating in Gas–Cooled Electrical Machines", *IEEE Conference Paper*, No. 154, pp. 1–9, Nov. 17, 1970.

* cited by examiner

*Primary Examiner*—N. Le
*Assistant Examiner*—Vincent Q. Nguyen
(74) *Attorney, Agent, or Firm*—Leydig, Voit & Mayer Ltd.

(57) ABSTRACT

A generator interior cooling gas monitor includes a cooling gas introduction pipe for introducing a cooling gas into the interior of a generator, a mass spectrograph connected to the cooling gas introduction pipe for separating the substances in the cooling gas introduced through the cooling gas introduction pipe according to the masses of each of the substances and detecting the mass, and a computer for subjecting mass data detected by the mass spectrograph to an arithmetic operation and displaying the result of the arithmetic operation.

17 Claims, 6 Drawing Sheets

FIG. 2
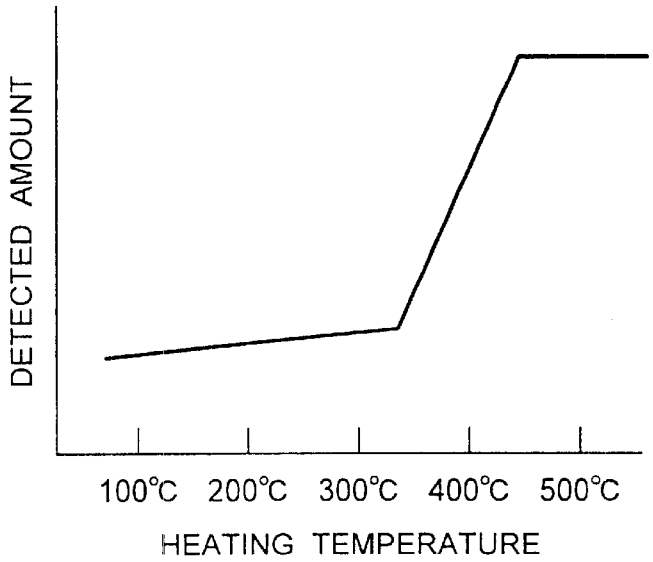
FIG. 3
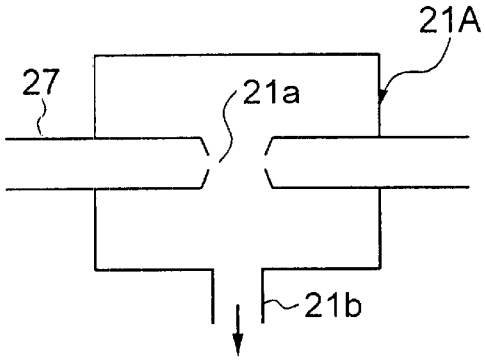
FIG. 4
| DETECTED MOLECULES | TOLUENE | BISPHENOL A |
|---|---|---|
| WITHOUT SEPARATOR | 2ppm | 5ppm |
| WITH SEPARATOR | 0.5ppm | 0.5ppm |

GENERATOR INTERIOR COOLING GAS MONITOR AND MONITOR SYSTEM

BACKGROUND OF THE INVENTION

1. Field of the Invention

The present invention relates to a monitor and a monitor system for monitoring overheating of the materials constituting the interior of a generator and the purity of gas in the interior of the generator.

2. Description of the Related Art

Since generators supply electric power which is important in a community, it is essential to prevent occurrence of accidents in them. For this purpose, there have been used apparatuses for monitoring the gas in generators and detecting occurrence of overheating by which the generators fail.

There have been proposed heretofore monitors for monitoring overheating in the interior of a generator in operation by "Immediate Detection of Overheating in Gas-Cooled Electrical Machines (C. C. Carson et al., IEEE Conference Paper, 71C, p154 (1971)), "The Ion Chamber Detector as a Monitor of Thermally Produced Particles" (G. F. Skala, J. de Recherches Atmospherique, April–September, p189 (1966)), and U.S. Pat. Nos. 3,427,880, 3,573,460, and 3,972,225.

These conventional monitors are roughly divided into a monitor unit and a unit for confirming overheating by supporting the monitor, and the monitor is further divided into two devices using different measuring principles.

The conventional monitors will successively be described below.

FIG. 8 is a view showing a basic arrangement of a conventional monitor described in, for example, "Immediate Detection of Overheating in Gas-cooled Electrical Machines" (C. C. Carson et al., IEEE Conference Paper, 71C, P154(1971)).

In FIG. 8, the conventional monitor 1 includes a main body vessel 2 having a pipe 3 connected thereto for introducing the cooling gas in the interior of a generator (not shown) into the vessel 2, an α ray source 4 for ionizing the cooling gas introduced into the main body vessel 2, a pair of electrodes 6 and 7 disposed in the vicinity of the gas outlet 5 of the main body vessel 2, an ammeter 8 for measuring the current flowing between the pair of electrodes 6 and 7, and a power supply 9 for imposing a voltage between the pair of electrodes 6 and 7.

Thorium is used as the α ray source 4. Further, hydrogen gas is used as the cooling gas.

Note that, while not shown, the current value measured with the ammeter 8 can be recorded on a recording sheet and the like.

Next, operation of the monitor 1 arranged as above will be described.

First, the monitor 1 is connected such that hydrogen gas as the cooling gas of the generator is introduced into the main body vessel 2 through the pipe 3 and the hydrogen gas discharged from the gas outlet 5 is returned into the interior of the generator.

Then, the cooling hydrogen gas in the interior of the generator is partly introduced into the main body vessel 2 through the pipe 3. The hydrogen gas introduced into the main body vessel 2 is ionized by an α ray irradiated from the α ray source 4. At that time, hydrogen is ionized, and ion pairs, that is, hydrogen ions having a positive charge and hydrogen ions having a negative charge are created. Then, the ionized hydrogen is partly attracted by and reaches the electrode 7, a current is generated between the electrode 7 and the main body vessel 2 (electrode 6), and the remaining hydrogen is discharged from the gas outlet 5, passing between the electrodes 6 and 7. The hydrogen gas discharged from the gas outlet 5 is returned in the interior of the generator.

When only hydrogen molecules exist in the cooling gas introduced into the main body vessel 2, the ionized hydrogen easily reaches the electrode 7 and a large ion current is observed by the ammeter 8 because the mass of the hydrogen molecules is very small.

In contrast, when small particles exist in the cooling gas in the interior of the generator, the number of hydrogen ions which reach the electrode 7 is reduced because the hydrogen ion pairs created in the main body vessel 2 bond to the small particles again and lose their charge. Further, while the small particles are ionized at the same time in the main body vessel 2, they do not almost reach the electrode 7 because it is difficult for the mass of the small particles to largely move. In short, when small particles exits in the cooling gas, the number of ions which reach the electrode 7 is reduced and current measured with the ammeter 8 is decreased.

Reduction of a current value caused by existence of small particles depends on Formula 1 as described in "The Ion Chamber Detector as a Monitor of Thermally Produced Particles (G. F. Skala, J. de Recherches Atmospherique, April–September, p189 (1966)).

$$-\Delta I = Qe(1-Fc)rZ/2\alpha \qquad \text{(Formula 1)}$$

where, −ΔI is the reduction of a current value, Q is the flow rate of hydrogen gas, e is the elementary charge, Fc is the ratio of ionized small particles, r is the diameter of small particles, Z is the concentration of small particles in hydrogen gas, and α shows a rebonding constant of ions.

In (Formula 1), since Q, e, Fc and a are constants, when a small particle having a large product of r (diameter) and Z (concentration) exists, a current value measured with the ammeter 8 is reduced by −ΔI as compared with a case in which the small particle does not exist.

Then, the small particles which can be detected with the conventional monitor 1 are specifically small particles having a diameter of 0.001 μm to 0.1 μm.

Next, the steps by which the conventional monitor 1 detects overheating in the interior of the generator will be described.

First, the value of a current flowing between the pair of electrodes 6 and 7 is measured with the ammeter 8 in the ordinary operating state of the generator in which overheating is not caused at all in the interior thereof, and the current value is recorded as a current level when the generator operates normally. Usually, the current value is measured successively at all times and recorded on a recording sheet and the like.

When a current value being monitored is lowered at a certain time, it is determined that small particles exist based on the principle shown by the above-mentioned Formula 1. In contrast, it is known that the materials in the interior of the generator generate small particles at the beginning of overheating. Therefore, when it is detected that a current is reduced by a value larger than a certain amount, it is determined that overheating is caused in the interior of the generator and an alarm is issued.

As described above, the conventional monitor 1 is a device for detecting the existence of small particles by the reduction of an ion current and has an object monitoring overheating of the generator by the detection of the small particles. Then, the conventional monitor 1 has only a function for detecting small particles and does not have a function for specifying the materials constituting detected small particles.

Further, the conventional monitor described in U.S. Pat. No. 3,427,880 is a device for detecting the existence of small particles by generating vapor droplets including small particles in cooling gas as nuclei and optically measuring the number of droplets and has an object for monitoring overheating of a generator by the detection of the small particles. Then, the conventional monitor also has only a function for detecting small particles and does not have a function for specifying the materials constituting detected small particles.

As described above, it is difficult for the conventional monitor 1 to specify whether detected small particles are generated by overheating or generated by friction and the like other than the overheating. Thus, a monitor used for determining whether the material in the interior of a generator is overheated or not is proposed in U.S. Pat. No. 3,972,255, and the like.

FIG. 9 is a view showing a basic arrangement of the conventional monitor described in, for example, U.S. Pat. No. 3,972,225.

In FIG. 9, the conventional monitor 10 includes a monitor unit 1 having a function for detecting whether small particles exist in the cooling gas of a generator 11 or not and a collection unit 12 having a function for collecting small particles. Then, the pipe 3 of the monitor 1 is connected to a pipe 14 through an open/close valve 17 and the gas outlet 5 of the monitor 1 is connected to the generator 11. Further, the pipe 15 of the collection unit 12 is connected to the pipe 14 through an open/close valve 18 and the gas outlet 16 of the collection unit 12 is connected to the generator 11.

Next, operation of the monitor 10 arranged as above will be described.

First, the open/close valve 17 is opened and the open/close valve 18 is closed. Then, the cooling gas in the generator 11 is partly introduced into the monitor 1 through the pipes 14 and 3 and returned into the generator 11 through the gas outlet 5. At that time, the monitor 1 monitors whether small particles exist in the cooling gas based on the magnitude of an ion current as described above. If the ion current is lower than the level of a threshold value, it is determined that small particles of a predetermined concentration exist and an alarm signal is output. When the alarm signal is output, the open/close valve 17 is opened after it is delayed a predetermined period of time by a delay relay 19 and introduction of cooling gas into the monitor 1 is stopped. Further, the alarm signal and an output from the delay relay 19 are supplied to a signal regulator 13 and the open/close valve 18 is opened in response to a signal output from the signal regulator 13. With this operation, the cooling gas is introduced into the collection unit 12 through the pipes 14 and 15 and thereafter returned to the generator 11 from the gas output 16. Then, small particles in the cooling gas are collected in the collection unit 12.

After a predetermined amount of the cooling gas is introduced as described above, the collection unit 12 is removed and the collected small particles are analyzed with another analyzer. Note that, in analysis, a gas chromatograph, mass spectrograph, infrared spectrograph and the like are ordinarily used independently or in combination. When the collected small particles are not metals and inorganic substances and are certain types of organic substances as the result of analysis, it is determined that overheating is caused in the interior of the generator 11.

Further, there is proposed by "Implementation of Pyrolysate Analysis of Materials Employing Tagging Compounds to Locate an Overheated Area in a Generator" (S. C. Barton et al., IEEE Trans., PAS-100, 4983 (1981)) a method of previously applying a paint, from which small particles are liable to be generated, to the materials constituting the interior of a generator, collecting small particles by a conventional device similar to the monitor 10 and identifying the small particles with a gas chromatograph for the purpose of determining overheating of the generator at an earlier stage and specifying which portions in the interior of the generator are overheated.

Further, there is known a conventional example of an oil collection unit mounted on an oil-filled transformer. In the conventional example, after at least a predetermined amount of oil is collected by the oil collection unit, the collection unit is removed and the collected oil is analyzed separately with a gas chromatograph and the like.

The conventional device similar to the conventional monitor 10 is a device for collecting small particles in cooling gas and used to determine overheating the materials constituting the interior of a generator through analysis of collected materials.

The conventional monitor 1 has only the function for detecting small particles generated in a generator, and even if small particles are detected, it is difficult for the monitor 1 to find what types of materials the small particles are. That is, it is impossible for the conventional monitor 1 to make it apparent whether the small particles are organic components generated by overheating of the materials constituting the interior of a generator or mists of lubrication oil which have no relation with overheating. Thus, there is a problem in the conventional monitor 1 that even if the monitor 1 detects small particles and issues an alarm, there is a possibility that the alarm is issued by a cause such as lubrication oil and the like other than overheating and thus it cannot be instantly determined that overheating has been generated.

Further, the conventional monitor 10 making use of the collection unit 12 can analyze what materials small particles are and can assume that the small particles are generated by a constituting material. In the conventional monitor 10, however, since the gas in a generator must be caused to pass through the collection unit 12 once and then analyzed separately by removing the collection unit 12, there is a problem that a long time is necessary until overheating is determined. That is, since overheating of a generator cannot be determined at an early stage, there is a danger that an accident is caused thereby.

When a generator is overheated, it is preferable to specify an overheated portion at an early stage because it is necessary to repair an overheated portion instantly by stopping the generator. Since the conventional monitor 1 cannot specify a source from which small particles are generated, it is impossible for the monitor 1 to specify a portion where small particles are generated. Thus, there arises a problem in the conventional monitor 1 that even if overheating can be detected, a long time is necessary to restore a generator.

Further, when a special paint is applied to the interior of a generator and the conventional monitor 10 is used, there is a possibility to specify an overheated portion. When the conventional monitor 10 is used, however, since a long time is necessary to determine overheating as described above, there is a problem that an accident may be caused while the overheating is being determined and that this method is effective only to a generator the interior of which is previously painted. In general, since previous application of the paint has a problem that it is expensive and time-consuming, it cannot be said that this method is widely used in generators. Generators are scarcely painted, for example, in Japan. Accordingly, almost all the generators installed in Japan are not provided with devices capable of specifying a portion where overheating is caused.

SUMMARY OF THE INVENTION

An object of the present invention, which was made to solve the above problems, is to provide a generator interior cooling gas monitor and monitor system capable of giving determination in a short time, when overheating is caused in the interior of an existing generator, by detecting the overheating without the need of a separate analyzing method in the state in which the monitor and monitor system are connected to the generator. The term "decision" used here means to decide presence or absence of overheating and a degree of overheating when it is present by discriminating the occurrence of overheating in the materials constituting the interior of the generator from generation of mists from other materials such as, for example, lubrication oil.

Another object of the present invention is to provide a generator interior cooling gas monitor and monitor system capable of identifying a material constituting the interior of a generator or a portion of the generator from which overheating is caused in the state in which the monitor and monitor system are connected to the generator without previously applying a special paint to the interior of the generator and without using a separate analyzing method.

In order to achieve the above object, according to one aspect of the present invention, there is provided a generator interior cooling gas monitor which includes a cooling gas introduction pipe for introducing the cooling gas in the interior of a generator, a mass spectrograph connected to the cooling gas introduction pipe for separating the substances in the cooling gas introduced through the cooling gas introduction pipe in each mass of the substances and detecting them, and a computer for subjecting the data detected by the mass spectrograph to arithmetic operation and displaying the result of the arithmetic operation.

According to another aspect of the present invention, there is provided a generator interior cooling gas monitor system in which a plurality of sets of generator interior cooling gas monitors, each of which includes a cooling gas introduction pipe for introducing the cooling gas in the interior of a generator, a mass spectrograph connected to the cooling gas introduction pipe for separating the substances in the cooling gas introduced through the cooling gas introduction pipe in each mass of the substances and detecting them, and a computer for subjecting the data detected by the mass spectrograph to arithmetic operation and displaying the result of the arithmetic operation, are connected to each other through a computer network, and any of the monitors can perform monitoring and determination referring to the data of the monitors other than it.

According to still another aspect of the present invention, there is provided a generator interior cooling gas monitor system in which a generator interior cooling gas monitor, which includes a cooling gas introduction pipe for introducing the cooling gas in the interior of a generator, a mass spectrograph connected to the cooling gas introduction pipe for separating the substances in the cooling gas introduced through the cooling gas introduction pipe in each mass of the substances and detecting them, and a computer for subjecting the data detected by the mass spectrograph to arithmetic operation and displaying the result of the arithmetic operation, is connected to another monitor through a computer network so that the above monitor can perform monitoring and determination referring to the data of the another monitor.

BRIEF DESCRIPTION OF THE DRAWINGS

FIG. 2 is a graph showing a relationship between an overheat temperature and an amount of detection in the monitor according to the embodiment 1 of the present invention;

FIG. 3 is a schematic view showing a structure of a separator in the monitor according to the embodiment 1 of the present invention;

FIG. 4 is a table showing an effect of disposition of the separator in the monitor according to the embodiment 1 of the present invention;

DESCRIPTION OF THE PREFERRED EMBODIMENTS

Embodiment 1

Figure 1:
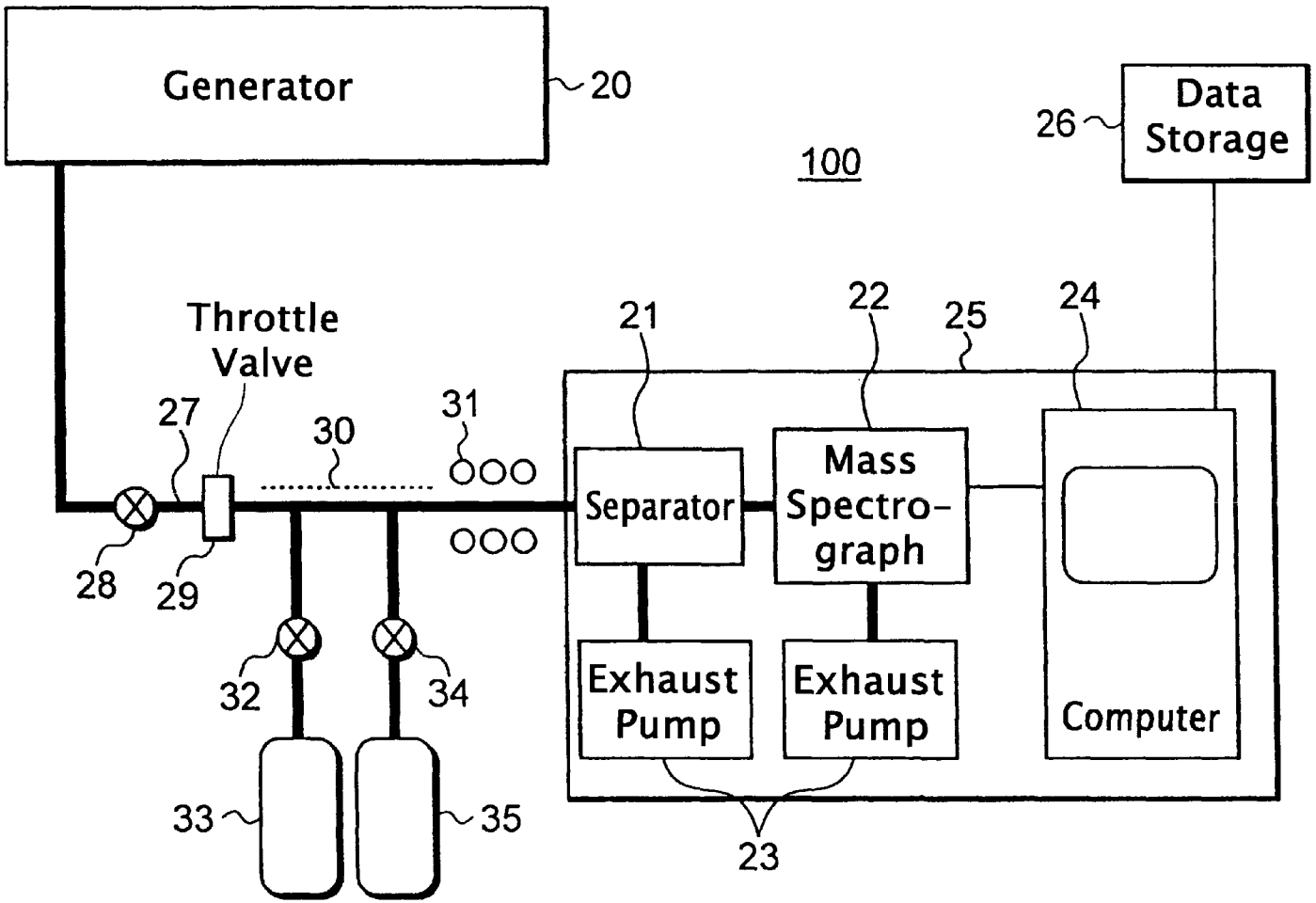
FIG. 1 is a schematic view showing a state in which the cooling gas in a generator is monitored using a monitor according to an embodiment 1 of the present invention.

FIG. 1 is a schematic view showing a state in which the cooling gas in a generator is monitored using a generator interior cooling gas monitor according to an embodiment 1 of the present invention. A generator 20 in FIG. 1 is a hydrogen-cooled type large turbine generator.

In FIG. 1, a monitor 100 includes a separator 21 for extracting the small particles in the cooling gas (in this case, hydrogen gas) in the interior of the generator 20, a mass spectrograph 22 for analyzing the small particles extracted by the separator 21, an exhaust pump 23 for evacuating the separator 21 and the mass spectrograph 22, a computer 24 for controlling components constituting the monitor 100, analyzing the data obtained by the mass spectrograph 22, displaying the result of analysis, and determining overheating, a housing 25 in which the separator 21, the mass spectrograph 22 and the computer 24 are accommodated, a data storing unit 26 for storing the analyzed data and the like, a gas introduction pipe 27 for introducing the cooling gas in the interior of the generator 20 into the separator 21, an open/close valve 28 disposed in the pipe 27, a throttle valve 29 disposed in the pipe 27 for providing a pressure difference, a pipe heater 30, a thermal cracking heater 31 for thermally cracking the small particles contained in the cooling gas in the pipe 27, a pressure regulating inert gas cylinder 33 connected to the pipe 27 through a valve 32, and a calibration sample cylinder 35 connected to the pipe 27 through a valve 34. Note that a gas switch valve is composed of the open/close valve 28 and the valve 32.

How the monitor 100 is arranged will be described below in detail.

While the gas introduction pipe 27 may be composed of an ordinary pipe, it is preferable to use a pipe composed of quartz or stainless steel to suppress that the pipe 27 adsorbs organic substances and the like contained in the cooling gas flowing through the pipe 27.

While it is preferable to use a valve capable of adjusting a degree of opening and closing as the throttle valve 29, the throttle valve 29 may be any valve so long as it can make a pressure difference between the interior of the generator 20 and the interior of the main body of the monitor 100, and for example, a metal sheet having a small hole formed therethrough and a tube having a small inside diameter may be employed.

The pipe heater 30 is disposed to cause the organic substances contained in the cooling gas to effectively reach up to the mass spectrograph 22. The applicant has found that bisphenol A is generated by thermally cracking epoxy resin. Since the inner insulated section of the generator is mainly composed of epoxy resin, the applicant has come up with an idea that an important substance which exhibits overheating of a generator is bisphenol A. Further, the pipe 27 is heated to at least 150° C. by the pipe heater 30. This is because that since the melting point of bisphenol A is 150° C., if a temperature of the pipe 27 is less than 150, a lot of bisphenol A is condensed on the inner surface of the pipe 27 and cannot be supplied to the pipe 27. That is, even if the cooling gas containing bisphenol A is introduced into the mass spectrograph 22 through the pipe which is not heated, the bisphenol A cannot be detected unless it is generated in a large amount. While the pipe heater 30 is disposed to partially heat the pipe 27, it is preferable to maintain the overall pipe 27 and the separator 21 at 150° C. or higher at all times.

The thermal cracking heater 31 is disposed to thermally crack the small particles contained in the cooling gas. The thermal cracking heater 31 is provided based on the finding of the applicant that a larger amount of bisphenol A can be detected when the cooling gas containing the bisphenol A generated by overheating of the interior of the generator is heated to high temperature. It is presumed this is because that the molecules (organic substances) of bisphenol A and small particles containing the molecules of bisphenol A are contained in the gas generated by overheating epoxy resin, thus bisphenol A (organic substances) is discharged by the thermal cracking of the small particles which is carried out by heating the gas generated by overheating to high temperature.

FIG. 2 shows the result of measurement of an amount of bisphenol A detected with the mass spectrograph 22 when a temperature at which it was heated by the thermal cracking heater 31 was variously changed. It can be found from FIG. 2 that when the gas is heated to at least 350° C. by the thermal cracking heater 31, a greatly increased amount of bisphenol A can be detected. Thus, it is sufficient that the thermal cracking heater 31 can partly heat the pipe 27 to at least 350° C., and a resistance heater, infrared heater, high frequency heater, and the like can be suitably used as the thermal cracking heater 31.

The gas separator 21 exhausts only hydrogen gas from the cooling gas, which was supplied through the pipe 27 and contained a minute amount of substances (for example, bisphenol A) and supplies the cooling gas to the mass spectrograph 22 after a concentration of the substances in the cooling gas is increased. A jet separator 21A shown in FIG. 3 is employed here as the separator 21. The jet separator 21A is composed of a glass having a thin hole 21*a* of 0.01 mm in the interior thereof and actuated by the exhaust pump 23 connected to an exhaust hole 21*b*. With the above operation, the hydrogen gas which is a main component of the cooling gas supplied through the piping 27 is exhausted and molecules heavier than hydrogen gas are passed. Thus, the concentration of the bisphenol A and the like in the cooling gas supplied to the mass spectrograph 22 can be increased.

A heating temperature of the thermal cracking heater 31 was set to 500° C. and a detected lower limit concentration of toluene and bisphenol A was measured as to a case in which the jet separator 21A was used and a case in which it was not used. FIG. 4 shows the result of the measurement. From FIG. 4, since the detected lower limit concentration is lowered to one tenth when the jet separator 21A is mounted, a more minute amount of substances generated by overheating can be detected. However, when a concentration of the bisphenol A in the hydrogen gas exceeds 1 ppm, since it is anticipated that the materials constituting the interior of the generator has reached to a very high overheat temperature, it can be monitored without the separator. Further, even if a detected substance is very light toluene, a detected lower limit concentration similar to that of bisphenol A is realized, the monitor 100 can be used as a detector for almost all the substances. Note that the gas separator 21 is not limited to the jet separator 21A and any separator may be used so long as it can separate the cooling gas from substances other than it and, for example, a separation column used in a gas chromatograph may be used.

The mass spectrograph 22 is an instrument for separating the substances in the gas introduced into the interior thereof in each mass of the substances and detecting them.

Figure 5A:
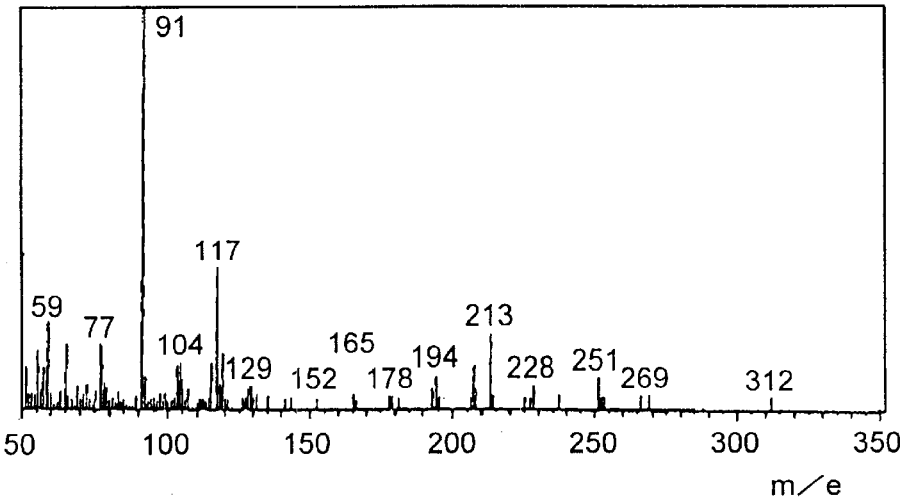
FIGS. 5A to 5C are graphs showing mass spectra produced by the monitor according to the embodiment 1 of the present invention.
Figure 5B:
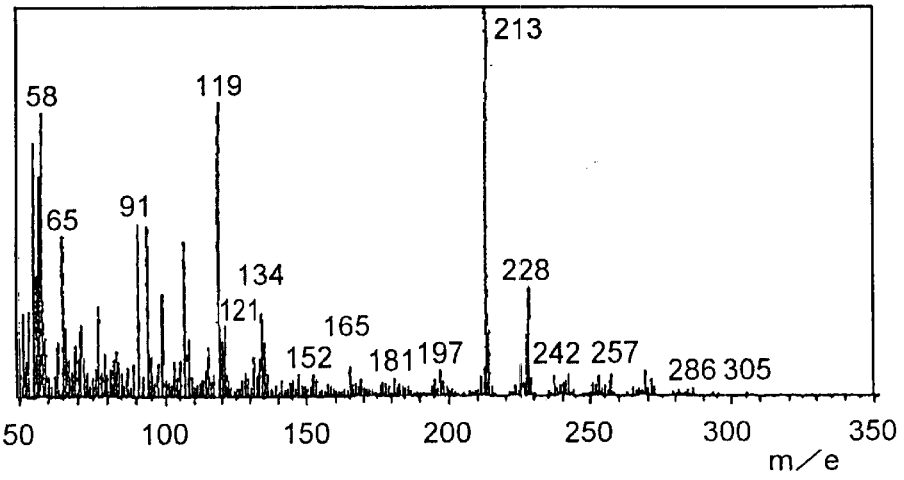
Figure 5C:
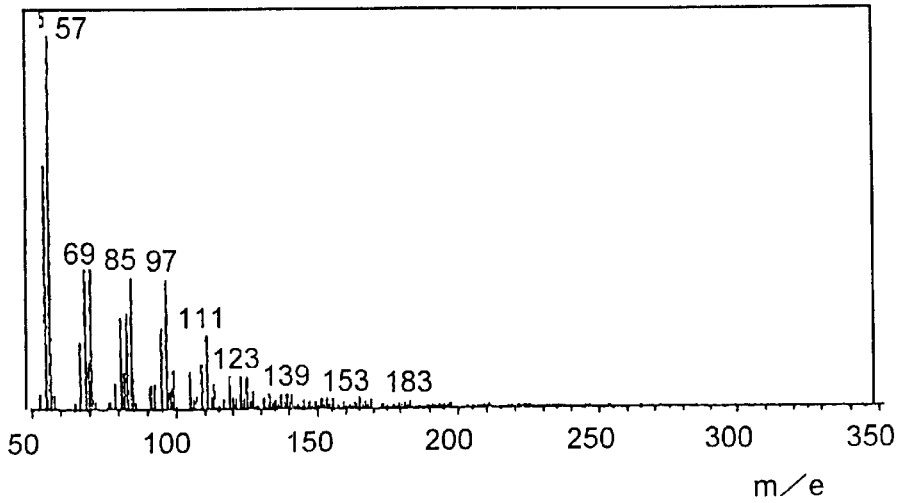

FIGS. 5A to 5C are graphs showing the mass spectrums of the gas generated from two kinds of epoxy resins and turbine lubrication oil which were overheated and measured with a quadrupole mass spectrograph. FIGS. 5A and 5B show the mass spectrums of the gas generated by overheating the epoxy resins and FIG. 5C shows the mass spectrums of the gas generated from the turbine lubrication oil. In the figures, the ordinate shows a detected intensity and the abscissa shows a ratio of mass to charge (m/e) of ions generated in a mass spectrograph.

It can be found from FIGS. 5A to 5C that the spectrums of the masses are different depending upon detected substances. That is, since detected substances can be specified from the overall mass spectrums, it can be easily determined whether the small particles contained in the cooling gas result from the gas generated from the overheated turbine lubrication oil or from the materials constituting the interior of the generator. Further, as to the gases generated from the substances other than the above substances, since the mass spectrums thereof, which are peculiar to the substances, also can be obtained, an overheated section of the generator can be determined by previously measuring the mass spectrums of the overheat gas generated from the respective materials constituting the interior of the generator, storing them in the data storing unit 26 and comparing a mass spectrum detected while the overheat gas is monitored with the data stored in the data storing unit 26.

Note that, while the quadrupole mass spectrograph is advantageous as the mass spectrograph 22 because it is less expensive and small in size, a double convergence type mass spectrometer and a time-of-flight mass spectrometer may be used.

Further, it can be found from FIGS. 5A and 5B that the mass spectrums of bisphenol A, which is contained in the overheat gas generated from the epoxy resin, strongly appear at the mass numbers 228 and 213. Further, there does not exist any substance, which has the mass number 4 or less, other than hydrogen and helium which have no relation to overheating of the generator. Thus, it is preferable that the mass spectrograph 22, which is applied to the monitor 100 for monitoring the cooling gas in the interior of the generator, have the mass scanning range covering the mass numbers 4 to 300.

The monitor 100 is not used to detect only bisphenol A. That is, bisphenol A is the substance which exhibits overheating most characteristically in the gases generated by overheating from the materials constituting the interior of the generator and is most difficult to be detected because its melting point is low. Thus, when the mass spectrograph 22 can detect bisphenol A, it can detect any other substances. In general, even if a material is overheated, since bisphenol A is generated therefrom in a very small amount, it cannot be detected at the beginning of overheating in many cases. Since detection of no bisphenol A results only in that the peaks at the mass numbers 213 and 228 disappear from FIGS. 5A and 5B, the materials constituting the interior of the generator can be easily discriminated from the lubrication oil from the characteristics of the overall mass spectrums due to the effect of the use of the mass spectrograph 22.

Further, the monitor 100 also can find the purity of the cooling gas (hydrogen gas) by calculating the ratio of the sum of the detected intensities of the mass spectrums of the cooling gas, for example, hydrogen gas to the sum of all the mass spectrums. That is, the purity of the cooling gas in the interior of the generator also can be found.

The exhaust pump 23 is used to exhaust the cooling gas from the separator 21 as well as to evacuate the interior of the mass spectrograph 22 and to keep the interior in vacuum. A combination of a turbo molecule pump and an oil rotary pump and a combination of a turbo molecule pump and a dry pump are most effective as the exhaust pump 23. Further, the separator 21 and the mass spectrograph 22 may be exhausted by independent exhaust pumps 23 or by a single exhaust pump 23.

The computer 24 is used to process and display the data detected by the mass spectrograph 22. Further, the operation of the equipment such as the open/close valve 28, heaters 30 and 31, exhaust pump 23, data storing unit 26 and the like may be programmed and automatically controlled by the computer 24. In this case, overheating of the interior of the generator can be automatically monitored day and night without the assistance of an attendant.

The pressure adjustment inert gas is used to keep the internal pressure of the mass spectrograph 22 at a pressure similar to that when the cooling gas is introduced thereinto even if the open/close valve 28 is closed and the cooling gas is not introduced. As described above, when any of the cooling gas in the generator 20 and the inert gas in the inert gas cylinder 33 is introduced into the mass spectrograph 22 by switching the opening and closing of the open/close valve 28 and the valve 32 and the interior thereof is kept at a constant pressure at all times, it is possible to start monitoring of overheating at any time without waiting that the pressure in the generator 11 is stabilized. While gases, which do not corrode the interior of the monitor, such as hydrogen, helium, nitrogen, argon, xenon, and the like may be used as the inert gas, a gas having a purity as high as possible may be preferably used.

The calibration sample is poured into and used in a system so that the sensitivity and mass of the mass spectrograph 22 can be kept in a constant state at all times. In general, since the axes of the sensitivity and mass number of the mass spectrograph 22 may be dislocated by a change of the temperature in the mass spectrograph 22, it is preferable to introduce the calibration sample in the calibration sample cylinder 35 into the mass spectrograph 22 by periodically opening and closing the valve 34 and to calibrate them. Perfluorotetrabutylammonium (PFTBA), xenon gas, neon gas, etc. are used as the calibration sample. In particular, when the mass scanning range of the mass spectrograph 22 exceeds 200, perfluorotetrabutylammonium (PFTBA) is preferably used.

The housing 25 is arranged such that the temperature of the interior thereof can be measured and its vibration can be removed. The housing 25 is mainly used to keep the mass spectrograph 22 and the computer 24 at a constant temperature and to suppress transmission of vibration of the floor, on which they are installed, to them. This is because that it is necessary to suppress a temperature change and vibration, by which operation of the electric equipment such as the mass spectrograph 22 and computer 24 may be disturbed, in order to operate them stably.

An object of the data storing unit 26 is to periodically store the analysis data of the computer 24 and the operation record of a monitor main body. This is because that since the monitor is provided to cope with an accident which is rarely caused to the generator, if an accident or fire does occur in the generator, it is necessary to specify a cause of the accident by referring to the data later. While a magneto-optic recording unit or a floppy disc drive which is an ordinary external storing unit may be used as the data storing unit 26, it is preferable to install it at a remote site which is as far as possible from the monitor main body so that it is not affected by the accident of the generator. Further, since monitor data per hour exceeds 1 megabyte, it is preferable to use a recording unit having a large capacity such as the magneto-optic recording unit and the like.

Examples to which the monitor 100 is applied will be described below in detail.

EXAMPLE 1

As shown in FIG. 1, an example 1 was arranged such that the monitor 100 was connected to an air-cooled type turbine generator to monitor the internal gas of the generator.

In the example 1, the generator 20 was the air-cooling type turbine generator which had an output of 150 MW and was being operated. The pipe which was already installed in the generator 20 was used as the pipe from the generator 20 to the open/close valve 28. The open/close valve 28 was composed of a normally-closed electromagnetic valve, the gas introduction pipe 27 downstream of the open/close valve 28 was composed of a quartz pipe having an inside diameter of 2 mm and an outside diameter of 6 mm. The throttle valve 29 was arranged as a quartz partition wall which was disposed in the quarts pipe 27 and had a hole of 0.05 mm formed at the center thereof. When the throttle valve 29 was used, a pressure in a mass spectrograph 22 was $1\times10^{-4}$ pa when air as the cooling gas in the generator 20 was introduced thereinto. The pipe heater 30 was composed of a tape-like resistance heater wound around the entire length of the pipe 27 and the heating temperature thereof could be controlled by a temperature regulator. A resistance heater composed of a tungsten wire embedded in the quartz pipe 27 was used as the thermal cracking heater 31. The thermal cracking heater 31 might be embedded in a pipe structure or might be disposed in the cavity in the pipe or externally of the pipe. A glass jet separator shown in FIG. 3 and having a thin hole of 0.01 mm in the interior thereof was used as the separator 21 and the interior of it was exhausted by the exhaust pump 23.

A quadrupole mass spectrometer, which had a capability of a mass scanning range of from 1 to 400 and included a secondary electron multiplier tube, was used as the mass spectrograph 22 and an ionized voltage was set to 70 electron volts. While an oil rotary pump was used as the exhaust pump 23, a turbo molecule pump also was interposed between the mass spectrograph 22 and the exhaust pump 23. A general-purpose personal computer including a display CRT and a printer was used as the computer 24. The computer 24 could be used without any problem if it had a capability used generally at present and specially high speed was not required.

The inert gas cylinder 33 was a cylinder of 47 litters and filled with helium of high purity. The valve 32 (electromagnetic valve) was interposed between the inert gas cylinder 33 and the pipe 27. Perfluorotetrabutylammonium (PFTBA), which was contained in a glass vessel (calibration sample cylinder 35) of 10 cc, was used as the calibration sample, and the valve 34 (electromagnetic valve) was interposed between the calibration sample cylinder 35 and the pipe 27. The interior of the housing 25 was kept at 50° C. by a heater and the bottom of the housing 25 was supported by springs so that no vibration was transmitted thereto from a floor. When the monitor 100 is installed in a warm place, an air conditioner having a cooling function may be disposed in the housing 25. A magneto-optic disc was used as the data storing unit 26.

Next, operation of the monitor 100 will be described. Note that the monitor 100 was automatically operated by the computer 24.

First, the interiors of the separator 21 and the mass spectrograph 22 were evacuated by operating the exhaust pump 23, and the heater 30 was kept at 300° C. and the thermal cracking heater 31 was kept at 500° C. Then, the helium gas in the inert gas cylinder 33 was introduced into the mass spectrograph 22 by opening the valve 32 in a state in which the cooling gas in the generator 20 was not introduced by closing the open/close valve 28. At that time, the amount of the helium gas to be introduced was adjusted by the valve 32 mounted on the inert gas cylinder 33 so that the pressure in the mass spectrograph 22 was kept at $1\times10^{-4}$ pa.

The pressure in the interior of the mass spectrograph 22 may arbitrarily be set within the range in which mass analysis can be carried out, that is, at any optional value so long as it is generally $1\times10^{-3}$ pa or less.

Next, the valve 34 mounted on the cylinder 35 filled with PFTBA was opened only one second and about 10 $\mu$l of PFTBA was introduced into the mass spectrograph 22 through the pipe 27. Then, calibration of the monitor 100 was started by means of the mass spectrograph 22 in association with the opening of the valve 34. After the completion of calibration of the monitor 100, the open/close valve 28 was opened simultaneously with the closing of the valve 32 so that the cooling gas, that is, the air in the generator 20 was introduced into the monitor 100.

Then, analysis of the cooling gas was started with the mass spectrograph 22 in association with the introduction of the air. The detected intensities of respective mass numbers were successively detected at every predetermined time by the mass spectrograph 22, and the data of the sum of the detected intensities of the mass numbers 28 and 32, the sum of the detected intensities of the mass numbers 5 to 300, and the sum of the detected intensities of the mass numbers 119, 213 and 228 was stored in the recording unit (not shown) in the computer 24 and in the external data storing unit 26 (magneto-optic disc). The analysis was continued for 10 minutes and the data was successively displayed on the display unit of the computer 24.

As the result of the computer processing, the purity of the air was about 99.5% and was not changed with time and the mass numbers 119, 213 and 228 which exhibited the existence of bisphenol A were not detected. In contrast, since the sum of the detected intensities of the mass numbers 5 to 300 was approximately doubled in ten minutes, a first alarm, which warned overheating of the materials constituting the interior of the generator, was automatically displayed on the display unit of the computer 24.

The mass spectrograph 22 was set such that second introduction of gas and second analysis were started in 3 hours after the first introduction of gas and the first analysis were carried out for 10 minutes in an ordinary state in which no overheating and the like were presumed. However, since the overheating was presumed in that time, the second introduction of gas and the second analysis were automatically changed so that they are carried out in 10 minutes after the completion of the first introduction of gas and the first analysis as well as a period of time, during which the gas was introduced and the analysis was carried out, was changed to 30 minutes. Then, as the result of the second introduction of gas and the second analysis, the purity of the air was kept to 99.5% and the existence of bisphenol A was not confirmed. Further, since the sum of the detected intensities of the mass numbers 5 to 300 was maintained to the value which was same as that at the time the first measurement was finished, it was automatically determined that no overheating existed and the alarm was cleared. Thereafter, ordinary intervals of gas introduction and analysis were automatically restored and monitoring was continued.

The data in the above processes was stored in the data storing unit 26 just after the introduction of gas and the analysis were completed each time. However, the data of one day may be stored, for example, once a day at a predetermined time.

Further, since the mass spectrograph 22 was provided with the air-cooled type generator in the embodiment 1, the purity of the gas was monitored from the sum of the detected intensities of the mass numbers 28 and 32 which corresponded to nitrogen and oxygen by which air was specified and the sum of the detected intensities of the mass numbers other than the above. When, however, the mass spectrograph 22 was provided with a hydrogen-cooled generator or a water-cooled generator, it was sufficient to monitor the purity of gas from the detected intensity of the mass number 2 which corresponds to hydrogen gas and the sum of the detected intensities of the mass numbers other than the above.

Further, the safety of a power system was improved by coupling the monitor 100 with the generator 20.

Embodiment 2

Figure 6:
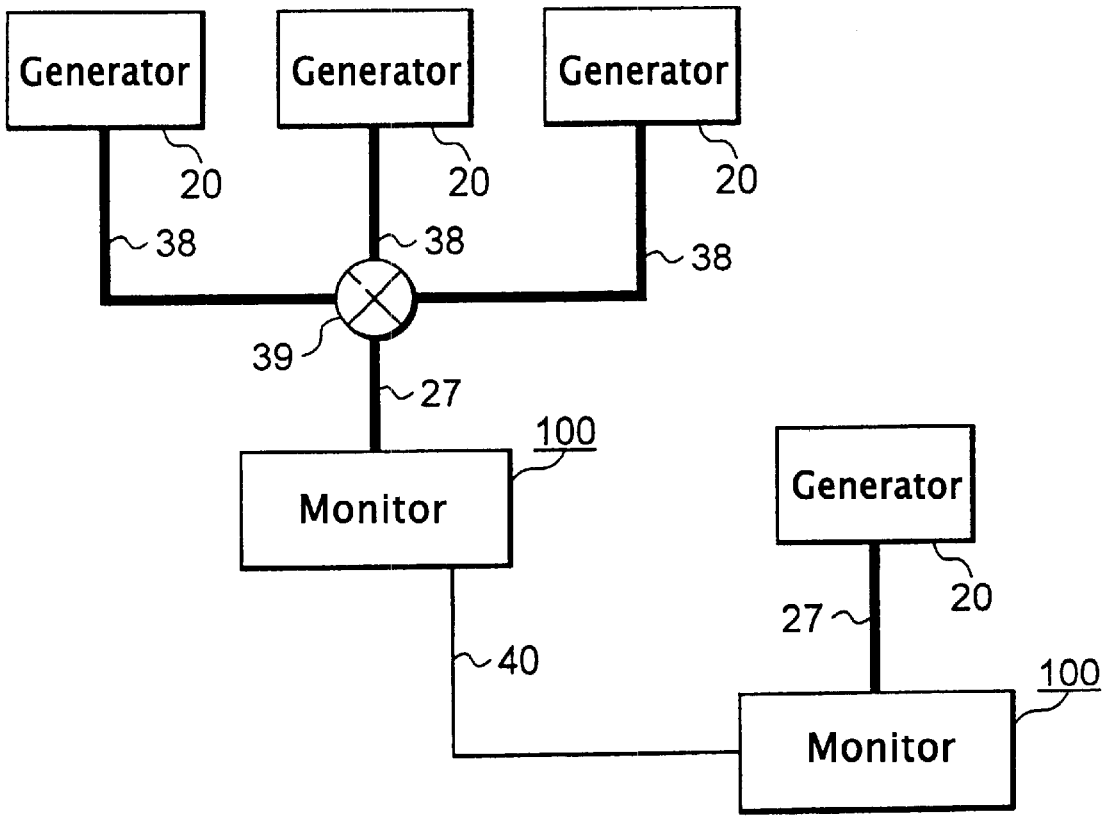
FIG. 6 is a schematic view explaining a generator interior cooling gas monitor system according to an embodiment 2 of the present invention.

FIG. 6 is a schematic view explaining a generator interior cooling gas monitor system using a monitor according to an embodiment 2 of the present invention. Specifically, the embodiment 2 is arranged such that the cooling gas in a plurality of generators was monitored by a single monitor 100 and a monitor 100 disposed in a different generator was coupled with the above monitor 100 through a network line (computer network).

In FIG. 6, the generators 20 are water-cooled generators. The cooling gas introduction pipe 27 of the single monitor 100 is branched to three branch pipes 38 upstream of it through a cooling gas switch valve 39. Then, the respective branch pipes 38 are connected to the interior of the generators 20, respectively. Further, the cooling gas introduction pipe 27 of the another monitor 100 is connected to the interior of the different generator 20. Further, the computers of the two monitors 100 are connected to each other through a network line 40.

Note that it is sufficient for the network line 40 to be arranged as a mechanism capable of transferring data, and, for example, a phone line, an optical communication line, wireless communication and the like may be used.

In the monitor system arranged as described above, since the cooling gas of any optional one of the generators 20 can be introduced into the monitor 100 by switching the cooling gas switch valve 39, the generator 20 to be monitored can be freely changed. Ordinarily, when the generator 20 to be monitored is successively changed each several hours, the three generators 20 can be uniformly monitored.

Further, since the computers of the two monitors 100 are connected to each other through the network line 40, data can be optionally transferred between the monitors 100. Thus, even if one of the generators 20 is installed at a remote site, a worker can confirm the monitor data of the generator 20 at the remote site from the monitor 100 located near to him. Further, monitoring can be carried out more accurately by taking the data of one of the monitors 100 in the data of the other.

Note that, while the three sets of the generator 20 are monitored by the single monitor 100 in the embodiment 2, the number of the generators 20 to be monitored is not limited. While there may be a case in which about 10 sets of the generators 20 are installed in one power station, the 10 sets of the generators 20 can be monitored by the single monitor 100.

Further, while the two monitors 100 are connected to each other through the network line 40 in the embodiment 2, it is preferable that a larger number of the monitors 100 be connected to each other through the network line 40. Further, a network server, which concentrically accumulates and stores the data of all the monitors 100, may be connected to all the monitors 100.

Embodiment 3

Figure 7:
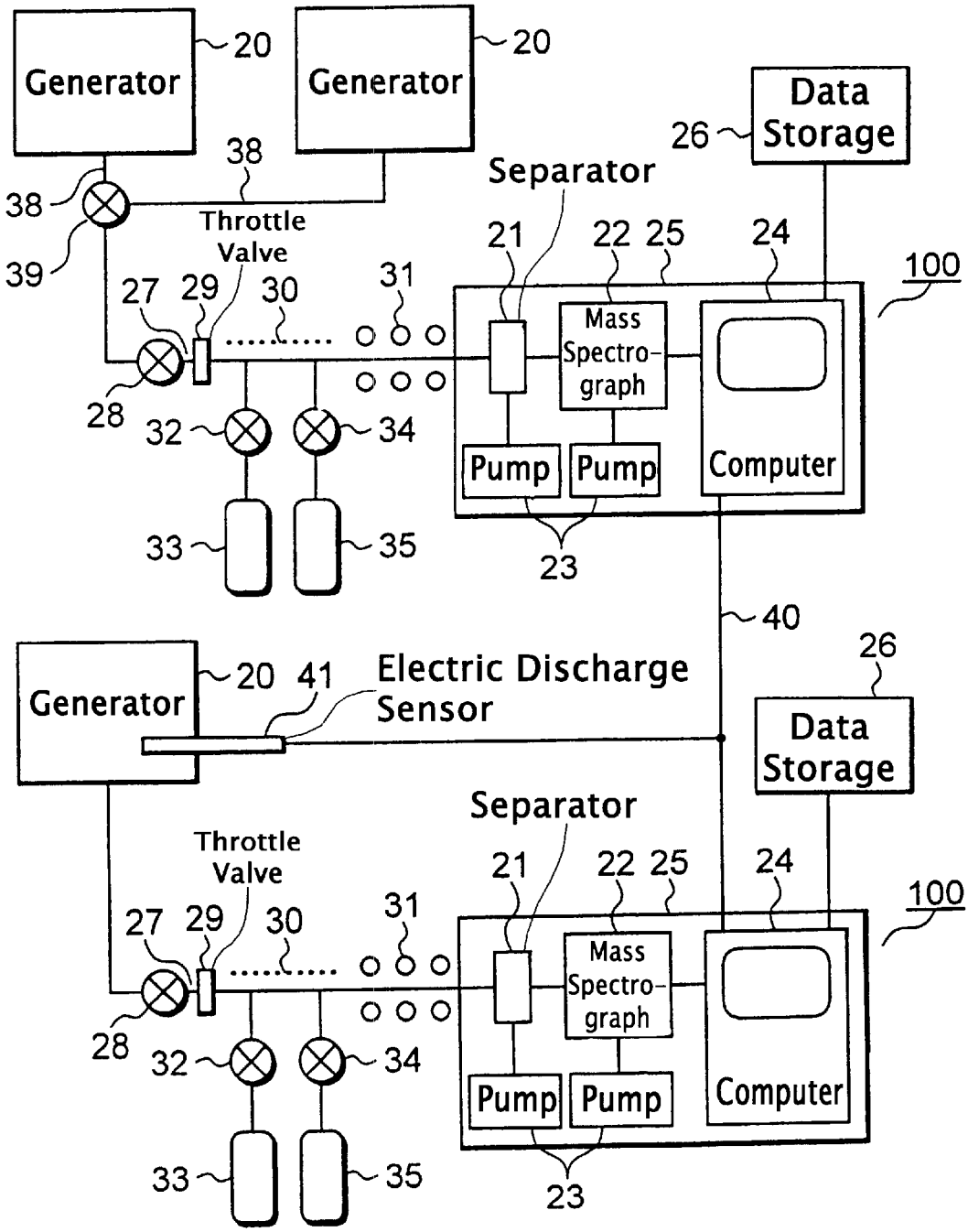
FIG. 7 is a schematic view explaining a generator interior cooling gas monitor system according to an embodiment 3 of the present invention.
Figure 8:
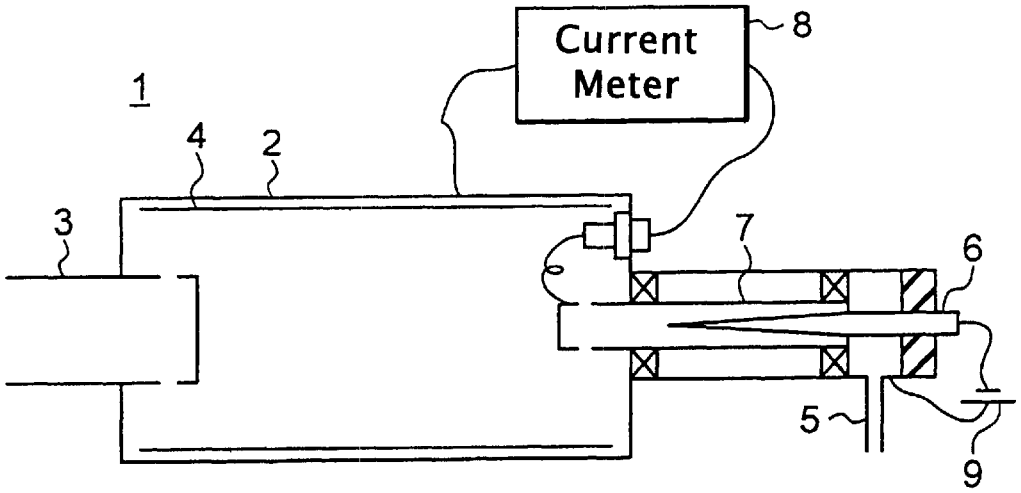
FIG. 8 PRIOR ART
FIG. 8 is a view showing a basic arrangement of a conventional monitor.
Figure 9:
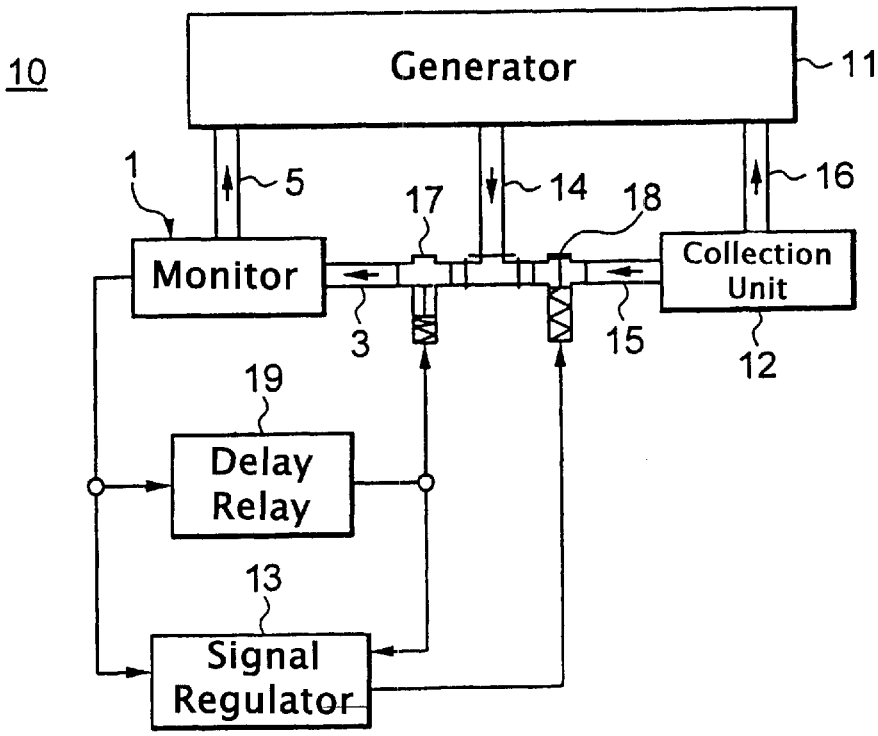
FIG. 9 PRIOR ART
FIG. 9 is a view showing a basic arrangement of another conventional monitor.

FIG. 7 is a schematic view explaining a generator interior cooling gas monitor system using a monitor according to an embodiment 3 of the present invention. The embodiment 3 shows how the cooling gas in the interiors of a plurality of hydrogen-cooled type turbine generators are monitored by monitors 100 connected to each other through a network line 40.

In FIG. 7, a stainless steel pipe having an outside diameter of ¼ inch is used as a cooling gas introduction pipe 27, an infrared heater is used as a pipe heater 30, and the temperature of the pipe 27 is kept to 200° C. A time-of-flight mass spectrometer 22 having the mass scanning range of 1 to 800 is used as a mass spectrograph 22. Further, generators 20 are the hydrogen-cooled type turbine generators. Note that the other arrangement of the monitor 100 is the same as that of the above embodiment 1.

Furthermore, an electric discharge sensor 41 as another monitor is disposed to one of the generators 20. Then, the two monitors 100 and the electric discharge sensor 41 are connected to each other through the network line 40.

In the monitor system arranged as described above, the generator 20 to be monitored is automatically switched every 5 hours by a cooling gas switch valve 39, and the function and operation of the monitors 100 are the same as those of the embodiment 1.

The two the monitors 100 connected to each other through the network line 40 are installed in a different power station apart about 300 km and periodically exchange their data. The number and distance of the monitors 100 connected through the network line 40 are not particularly limited, and a large effect can be expected even if, for example, 3 generators 20 in Japan are connected to 10 generators 20 in USA. An optical communication line is used as the network line 40.

In the embodiment 3, as the result of connection of the monitors 100 through the network line 40, the data of the 3 generators 20 when they are operated normally are averaged so that standard correct data can be referred to at all times. While one of the monitors 100 monitored the cooling gas of one of the generators 20, the sum of the detected intensities of the mass numbers 5 to 300 was increased 50% in 10 minutes, it was a natural variation having no relation to overheating and the like. Since the data was instantly sent to the another monitor 100, when the sum of the detected intensities of the mass numbers 5 to 300 was increased 45% in the generator 20 monitored by the another monitor 100, it could be determined at once that it was caused by a natural variation and not caused by overheating.

Further, as the result of connection of the partial electric discharge sensor 41 through the network line 40, when the monitor 100 found overheating of the generator 20, the overheating could be determined at once by referring to the partial electric discharge data from the partial electric discharge sensor 41.

As described above, the reliability of the monitors 100 can be more improved by the another monitor which is different from those of the present invention through the network cable 40, and the partial electric discharge monitor, a vibration sensor, a temperature measurement unit, a pressure gauge and the like are suitably used as the another monitor to be connected.

Note that, it has been described that the present invention is to be applied to monitor the cooling gas in the interior of the generator in the above respective embodiments, a similar effect can be achieved even if it is applied to monitor the cooling gas in the interior of a transformer, gas-insulated circuit breaker, motor and the like.

Since the present invention is arranged as described above, it can achieve the following effects.

According to the present invention, since there are provided the cooling gas introduction pipe for introducing the cooling gas in the interior of the generator, the mass spectrograph connected to the cooling gas introduction pipe for separating the substances in the cooling gas introduced through the cooling gas introduction pipe in each mass of the substances and detecting them, and the computer for subjecting the data detected by the mass spectrograph to arithmetic operation and displaying the result of the arithmetic operation, there can be obtained the generator interior cooling gas monitor capable of detecting overheating of materials constituting the interior of the generator in a short time by discriminating the substances from the mists of lubricating oil without the need of a different analyzer and without applying a special paint to the interior of the generator.

Since the separator or the separation column is disposed in the path of the cooling gas introduction pipe to separate and extract the substances other than the cooling gas therefrom, a detected lower limit concentration can be lowered, whereby overheating of the materials constituting the interior of the generator can be detected at earlier timing.

Since the thermal cracking heater capable of heating the cooling gas to at least 350° C. is disposed in the cooling gas introduction pipe at a portion thereof and thermally cracks the substances in the cooling gas flowing through the cooling gas introduction pipe, the amount of the gas generated by overheating and supplied to the mass spectrograph can be increased, whereby overheating of the materials constituting the interior of the generator can be detected at earlier timing.

Since the pipe heater capable of heating the cooling gas to at least 150° C. is disposed in the cooling gas introduction pipe and prevents the substances in the cooling gas from depositing on the inner wall surface of the cooling gas introduction pipe, the gas generated by overheating can effectively be supplied to the mass spectrograph, whereby overheating of the materials constituting the interior of the generator can be detected at earlier timing.

Since the inner diameter of the cooling gas introduction pipe is reduced at a portion thereof so as to provide a pressure difference between the interior of the generator and the interior of the mass spectrograph, the interior of the mass spectrograph can be set to a degree of vacuum at which analysis can be carried out.

Since the inert gas cylinder is connected to the cooling gas introduction pipe, the gas switch valve is disposed to the cooling gas introduction pipe, and the cooling gas is introduced into the system when monitor operation is performed as well as the inert gas in the inert gas cylinder is introduced into the system when the monitor operation is not performed, by switching the gas switch valve so that the pressure in the system is kept constant at all times, the monitor operation can be started at any time without waiting for stabilization of the pressure in the mass spectrograph.

Since the mechanism for introducing the calibration sample of the mass spectrograph thereinto is provided so that the sensitivity and mass of the mass spectrograph can be automatically calibrated, reliable monitor data can always be obtained with an excellent sensitivity.

Since the mass spectrograph is disposed in the housing having the temperature regulation mechanism and the vibration suppression mechanism, the monitor operation can be stably carried out at all times without depending upon the environment where the mass spectrograph is installed.

Since the cooling gas introduction pipe is branched to the plurality of branch pipes on the upstream side thereof through the cooling gas switch valve, the plurality of branch pipes are connected to the interiors of the different generators, and any optional generator can be monitored by switching the cooling gas switch valve, the cost of the monitor per one generator can be reduced.

Since all the operations such as introduction of the cooling gas, analysis by the mass spectrograph, control of the pressure in the system, processing of detected data, display of the detected data, and the like are carried out by the computer and the interior of the generator is automatically monitored without the assistance of an attendant, the generator can be monitored at all times even if it is installed in a place to which a person cannot easily access.

When the computer determines that the interior of the generator is overheated or that the purity of the cooling gas is reduced, since the computer shortens intervals at which the cooling gas is introduced and intervals at which analysis is carried out by the mass spectrograph and determines the overheating of the interior of the generator and the reduction of the purity of the cooling gas again, presence or absence of overheating and identification of an overheated material can be reliably performed at earlier timing.

Since the external storing unit is provided so that the computer can periodically store processed data in the external storing unit, even if an accident is cause to the generator and the monitor is broken, the monitor data of the generator to which the accident is caused is stored in the external storing unit and it can be referred to later.

The cooling gas is hydrogen gas and the computer calculates the sum of the detected intensities of the substance having the mass number 2 and the sum of the detected intensities of the substances other than the above substance based on the data detected by the mass spectrograph and monitors the purity of the cooling gas from the ratio of both the sums, the purity of the cooling gas can be monitored in addition to the overheating thereof.

The cooling gas is air and the computer calculates the sum of the detected intensities of the substances having the mass numbers 28 and 32 and the sum of the detected intensities of the substances other than the above substances based on the data detected by the mass spectrograph and monitors the purity of the cooling gas from the ratio of both the sums, the purity of the cooling gas can also be monitored in addition to the overheating thereof Since the computer calculates the sum of the detected intensities of the substances having the mass numbers ranging from 5 to 300 and monitors overheating in the interior of the generator from the change of the sum which is caused as a time passes, all the substances such as bisphenol A which exhibit overheating can be detected, whereby an overheat detecting sensitivity is improved.

The computer calculates the change, which is caused as a time passes, of the detected intensities of the mass numbers 119, 213 and 228 based on the data detected by the mass spectrograph and determines the presence or absence of bisphenol A or the detected amount of it, and when the substance is present or increased, the computer determines that overheating is caused in the interior of the generator. Accordingly, overheating of the epoxy resin as the materials constituting the interior of the generator can distinctly be determined.

In the generator interior cooling gas monitor system of the present invention, since a plurality of sets of any of the above monitors are connected to each other through the computer network and any of the monitors can perform monitoring and determination referring to the data of the monitors other than it, the monitoring data can be confirmed even at a location apart from the monitor as well as the accuracy of a monitored and determined value can be improved.

Further, in the generator interior cooling gas monitor system of the present invention, since any of the monitors is connected to the another monitor through the computer network and the monitor performs monitoring and determination referring to the data of the another monitor, the monitoring and decision can be performed in consideration of many data and the accuracy of a monitored and determined value can be improved.

What is claimed is:

1. A generator interior cooling gas monitor, comprising:

a cooling gas introduction pipe connected to a generator for introducing a cooling gas from a generator into the monitor;

a separator connected to said cooling gas introduction pipe, said separator extracting a main component of the cooling gas introduced through said cooling gas introduction pipe, thereby increasing concentration of substances in the cooling gas;

a mass spectrograph connected to said cooling gas introduction pipe for separating the substances in the cooling gas introduced through said separator according to masses of each of the substances, detecting the masses, and producing mass data; and a computer for subjecting the mass data produced by said mass spectrograph to arithmetic operation and displaying results of the arithmetic operation.

2. The generator interior cooling gas monitor according to claim 1, further comprising a thermal cracking heater heating the cooling gas to at least 350° C. and disposed in said cooling gas introduction pipe for thermally cracking the substances in the cooling gas flowing through said cooling gas introduction pipe.

3. The generator interior cooling gas monitor according to claim 1, further comprising a pipe heater for heating the cooling gas to at least 150° C. and disposed in said cooling gas introduction pipe for preventing the substances in an cooling gas from depositing on the inner wall surface of said cooling gas introduction pipe.

4. The generator interior cooling gas monitor according to claim 1, further comprising:

an inert gas cylinder connected to said cooling gas introduction pipe; and a gas switch valve disposed in said cooling gas introduction pipe, wherein the cooling gas is introduced into said cooling gas introduction pipe when a monitor operation is performed and an inert gas in the inert gas cylinder is introduced into said cooling gas introduction pipe when the monitor operation is not performed and said gas switch valve is switched so that pressure in said cooling gas introduction pipe is kept constant at all times.

5. The generator interior cooling gas monitor according to claim 1, further comprising a mechanism for introducing a calibration sample into said mass spectrograph, whereby sensitivity of and mass measurement by said mass spectrograph can be automatically calibrated.

6. The generator interior cooling gas monitor according to claim 1, wherein said mass spectrograph includes a housing having a temperature regulation mechanism and a vibration suppression mechanism.

7. The generator interior cooling gas monitor according to claim 1, including a cooling gas switch valve wherein said cooling gas introduction pipe includes a plurality of branch pipes on an upstream side, connected through said cooling gas switch valve, the plurality of branch pipes being connected to respective generators, for monitoring any of the generators by switching of said cooling gas switch valve.

8. The generator interior cooling gas monitor according to claim 1, wherein all operations, such as introduction of the cooling gas, analysis by said mass spectrograph, control of pressure, processing of the mass data, and display of the results, are controlled by said computer and the generator is automatically monitored without assistance of an attendant.

9. The generator interior cooling gas monitor according to claim 1, wherein when said computer determines that the generator is overheated or purity of the cooling gas is reduced, said computer shortens intervals at which the cooling gas is introduced and intervals at which analysis is carried out by said mass spectrograph and again determines if the generator is overheating and the purity of the cooling gas is reduced.

10. The generator interior cooling gas monitor according to claim 1, including an external storing unit so that said computer can periodically store the data in said external storing unit.

11. The generator interior cooling gas monitor according to claim 1, wherein the cooling gas is hydrogen gas and said computer calculates total detected intensities of a substance having mass number 2 and total detected intensities of substances having other mass numbers, based on the data produced by said mass spectrograph, and monitors purity of the cooling gas from a ratio of the total detected intensities.

12. The generator interior cooling gas monitor according to claim 1, wherein the cooling gas is air and said computer calculates total detected intensifies of substances having mass numbers 28 and 32 and total detected intensifies of the substances not having the mass numbers 28 and 32, based on the data produced by said mass spectrograph, and monitors purity of the cooling gas from a ratio of the total detected intensities.

13. The generator interior cooling gas monitor according to claim 1, wherein said computer calculates total detected intensities of substances having mass numbers ranging from 5 to 300 and monitors overheating in the generator from changes in the total detected intensities as time passes.

14. The generator interior cooling gas monitor according to claim 1, wherein said computer calculates a change, as time passes, of detected intensities of mass numbers 119, 213, and 228, based on the data produced by said mass spectrograph and determines presence or absence of bisphenol A, amount of bisphenol A, and when the bisphenol A is present and increases, to detect overheating in the generator.

15. The generator interior cooling gas monitor system, wherein a plurality of the monitors according to claim 1 are connected to each other through a computer network so that any of the monitors can perform monitoring and determination referring to the data produced by others of the monitors.

16. The generator interior cooling gas monitor system, wherein the monitor according to claim 1 is connected to a second monitor through a computer network so that the monitor can perform monitoring and determination referring to data produced at the second monitor unit.

17. A generator interior cooling gas monitor comprising:

a cooling gas introduction pipe connected to a generator for introducing a cooling gas from a generator into the monitor;

a mass spectrograph connected to said cooling gas introduction pipe for separating the substances in the cooling gas introduced through said separator according to masses of each of the substances, detecting the masses, and producing mass data; and a computer for subjecting the mass data produced by said mass spectrograph to arithmetic operation and displaying results of the arithmetic operation, wherein said cooling gas introduction pipe has an inner diameter reduced at a portion to provide a pressure difference between the generator and said mass spectrograph.

* * * * *